United States Patent [19]

Kasahara et al.

[11] 4,144,961

[45] Mar. 20, 1979

[54] METHOD AND APPARATUS FOR TRANSPORTING A GROUP OF YARN PACKAGES

[75] Inventors: Masao Kasahara; Noriyuki Kouguchi, both of Nishinomiya; Mitugu Inaba, Ibaragi; Masao Kagawa, Suita; Kunio Yamada, Komatsu; Hiroshi Tanida, Nomi, all of Japan

[73] Assignee: Toray Industries, Inc., Tokyo, Japan

[21] Appl. No.: 747,486

[22] Filed: Dec. 6, 1976

[51] Int. Cl.[2] ..... B65G 47/00

[52] U.S. Cl. ..... 198/472; 198/485; 242/35.5 A; 57/281; 198/646

[58] Field of Search ..... 198/350, 419, 472, 485, 198/646, 648, 651; 53/171, 197, 246; 57/52; 214/301; 242/35.5 A, 130.3

[56] References Cited

U.S. PATENT DOCUMENTS

| | | | |
|---|---|---|---|
| 1,686,375 | 10/1928 | Greer | 53/171 |
| 2,466,861 | 4/1949 | Peterson | 242/130.3 |
| 2,505,427 | 4/1950 | Peterson | 57/52 |
| 2,794,532 | 6/1957 | Snow | 242/35.5 A |
| 2,872,057 | 2/1959 | Wagner et al. | 198/646 |
| 3,701,410 | 10/1972 | Shields | 198/651 |
| 3,722,719 | 3/1973 | Frank | 214/301 |
| 3,773,190 | 11/1973 | Ishida et al. | 198/472 |
| 3,828,682 | 8/1974 | Klein | 57/52 |
| 3,889,797 | 6/1975 | Naito et al. | 198/350 |
| 3,902,615 | 9/1975 | Levy et al. | 214/301 |

*Primary Examiner*—Robert W. Saifer
*Assistant Examiner*—Richard K. Thomson
*Attorney, Agent, or Firm*—J. Harold Nissen

[57] ABSTRACT

Disclosed are a method and an apparatus for transporting a group of yarn packages, wherein a plurality of yarn packages is separately placed on each of a plurality of trays and a plurality of the trays is placed on a pallet, and then, the pallet is transported between successive stages of yarn processing. Said method and apparatus attain efficient transportation of yarn packages and eliminate a great amount of manual labor in yarn processing.

9 Claims, 22 Drawing Figures

METHOD AND APPARATUS FOR TRANSPORTING A GROUP OF YARN PACKAGES

BACKGROUND OF THE INVENTION

The invention relates to a method and apparatus for transporting a group of yarn packages between successive stages of yarn processing.

A method and an apparatus for transporting yarn packages, such as bobbins of textile yarn, from a yarn package forming machine, such as a draw-twisting machine, are disclosed in Japanese Patent Publications Nos. 12859/74 and 24812/74. This disclosed technique utilizes a long, narrow plate-shaped tray which has a plurality of pegs provided on its upper surface in the longitudinal direction with equal intervals therebetween. On each of the pegs, one bobbin is supported perpendicularly, and the bobbins are thus kept separated from each other.

According to the above-mentioned technique, a plurality of the trays are aligned at the front of, for example, a draw-twisting machine in a direction parallel to the direction of the aligned arrangement of take-up spindles. Full size bobbins formed on the draw-twisting machine are then extracted from the take-up spindles and put on the pegs of the trays. The trays, on which the full size bobbins have been placed, are taken out of the front of the draw-twisting machine one by one and then placed successively on a transportation carrier which stands by at one longitudinal end of the draw-twisting machine. On the upper surface of the transportation carrier, a plurality of members for supporting the trays is fixedly provided so that one tray can be supported on each of the supporting members. When all of the trays taken out of the front of the draw-twisting machine have been supported on the supporting members of the transportation carrier, the movement of the carrier is started. Then, at the destination, the trays are taken off of the transportation carrier.

In the above-mentioned transportation technique, where draw-twisting machine having 72 take-up spindles on one side thereof is used, 72 bobbins are formed simultaneously. In such a case, if each tray has 8 pegs, 9 trays corresponding to the number of take-up spindles, must be provided, at the front of the draw-twisting machine.

The above-mentioned transportation technique has made it possible to save, to a fair extent, the manual labor and operation time for the transportation of yarn packages from a yarn package forming machine. However, this known technique still involves the following drawbacks.

(1) When yarn packages are transferred to a subsequent stage of the yarn processing, such as for finishing, inspection or storage, if this transfer operation is performed in single tray units, effective improvement of the transfer efficiency can not be expected because the transfer operation must be repeatedly carried out and, thus, a long time is required for completion of such operation. For example, where 72 bobbins are to be transferred using trays each capable of holding 8 bobbins as in the case mentioned above, the same transfer operation must be conducted repeatedly 9 times.

(2) if the transfer operation is performed in tray units, control at the other stages of the yarn processing, such as for the classification and selection of the full size yarn packages and the preparation of the fresh bobbins or tubes for forming the yarn packages, is complicated.

(3) For the reasons set forth in (1) and (2) above, it is difficult to save a great amount of manual labor.

(4) When yarn packages are stored in tray units, the storage equipment becomes complicated and a large area is necessary for storage, and both of these factors are very disadvantageous from the practical point of view.

SUMMARY OF THE INVENTION

It is an object of the present invention to provide an efficient method and apparatus for transporting yarn packages between successive stages of yarn processing whereby the above-mentioned drawbacks of the known transportation technique can be eliminated.

Another object of the present invention is to provide a method and apparatus for transporting yarn packages from a yarn package forming machine, whereby the yarn package forming stage can be systematically and functionally connected with the other stages of the yarn processing, such as for the inspection, classification and storage of the full size yarn packages, and the preparation of the fresh bobbins or tubes for forming the yarn packages, so that a great amount of manual labor is saved.

To attain the above-mentioned objects, and other objects which will be apparent from the following description, in the transportation method according to the present invention, a plurality of yarn packages is separately placed on a tray and a plurality of such trays is placed on a pallet, and then, the pallet is transported between successive stages of yarn processing. Such transportation by a pallet, whereon a plurality of trays is mounted with each tray having a plurality of yarn packages, is one of the essential conditions of the transportation method according to the present invention. In this transportation method, it is advantageous that the yarn packages be separately placed on each tray in a perpendicular condition. When this transportation method is applied to a yarn package forming machine such as a draw-twisting machine provided with a plurality of spindles, the disposition order of yarn packages on each tray coincides with the alignment order of spindles. Consequently, the origin of each yarn package can be easily identified, in other words, the feedback of the inspection result to the spindles of the yarn package forming machine can be easily attained. This is one of the important advantages of the method according to the present invention.

The transportation apparatus of the present invention comprises basically trays which are each capable of holding a plurality of yarn packages, a pallet whereon a plurality of the trays can be placed and a transportation carrier which is capable of moving with the pallet mounted thereon. For example, the apparatus may comprise a transportation carrier which is capable of moving along a transportation passage formed in a factory, a pallet displaceably mounted on the transportation carrier whereon a plurality of the above-mentioned trays can be placed and means for placing the trays on the pallet one by one, or for unloading the trays from the pallet one by one. In addition, if the above-mentioned transportation apparatus is adopted for connecting yarn package forming machines, such as draw-twisting machines provided with a plurality of spindles, conveying means for displacing a plurality of trays, each tray being provided with a plurality of pegs for holding yarn packages or fresh bobbins arranged in an alignment with an interval identical to a spindle interval, from positions corresponding to groups of spindles to the above-mentioned placing means, is desirably utilized. This conveying means is also capable of positioning the above-mentioned trays received from the above-mentioned placing means at positions corresponding to groups of spindles. If the disposing level of the conveying coincides with the disposing level of the pallet of the transportation carrier, the above-mentioned placing means can be omitted.

It is one of the advantages of the transportation method and apparatus according to the present invention that it is able to be effectively applied to the yarn package forming machines, such as a drawing machine, draw-twisting machine, spin-winding machine, spin-draw-winding machine, false-twisting machine, draw-false-twisting machine and the like.

BRIEF EXPLANATION OF THE DRAWINGS

FIGS. 2A and 2B are schematic views of a tray adopted for the transportation system shown in FIG. 1, wherein FIG. 2A shows a side view of the tray and FIG. 2B shows a bottom view thereof;

FIGS. 4A and 4B are schematic views of a pallet adopted for the transportation system shown in FIG. 1, wherein FIG. 4A shows a plan view of the pallet and FIG. 4B shows a side view thereof;

FIGS. 11A, 11B and 11C are schematic views of a tray displacing mechanism mounted on the placing means, wherein FIG. 11A shows a side view thereof, and FIGS. 11B and 11C show enlarged views of the main parts thereof;

DETAILED EXPLANATION OF THE INVENTION

The term "yarn package" as used herein refers to various types of packages, such as bobbins, pirns, drums, cones, tubes, spools, cakes and cheeses, of yarns.

The method and apparatus for transporting a group of yarn packages according to the present invention will be hereinbelow illustrated by an embodiment thereof with reference to the accompanying drawings. The embodiment hereinbelow mentioned concerns a case where full size bobbins formed by a draw-twisting machine at a draw-twisting stage of a synthetic fiber yarn are transported to the subsequent stage such as for storage, inspection or classification.

Figure 1:
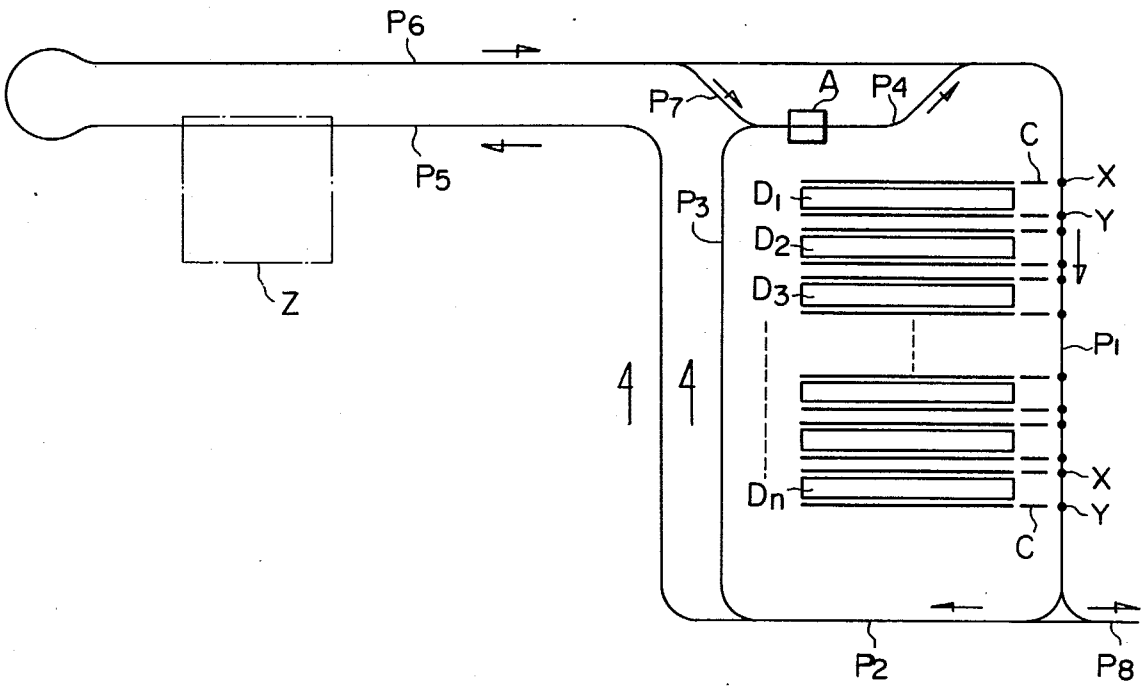
FIG. 1 is a schematic layout drawing of a factory provided with a transportation passage for a group of yarn packages which connects a draw-twisting stage provided with a plurality of unit machines to other stages involving an inspection stage, classification stage, storing stage and the like, wherein the transportation method and apparatus according to the present invention are advantageously adopted.

Referring now to FIG. 1, a plurality of draw-twisting machines $D_1$, $D_2$, $D_3$, . . . $D_n$ is arranged in parallel in a draw-twisting section in a factory. Transportation passages $P_1$, $P_2$, $P_3$ and $P_4$, along which a transportation carrier A runs, are provided surrounding the group of the draw-twisting machines. Passages $P_1$ and $R_3$ run along the direction of the arrangement of the draw-twisting machines, and passages $P_2$ and $P_4$ connect the passages $P_1$ and $P_3$ with each other. The passage $P_2$ is also connected to another passage $P_5$ passing through a section Z involving storage equipment for full size bobbins, a station for inspecting (or inspecting and classifying) the full size bobbins, a station for preparing fresh bobbins to be supplied and the like. The passage $P_1$ is also connected to another passage $P_8$ passing through a further section involving stages such as for finishing the draw-twisted yarns. The passage $P_5$ is connected to the passage $P_1$ by a passage $P_6$, and the passage $P_6$ is connected to the passage $P_4$ by a passage $P_7$. Between the longitudinal outer end of each of the draw-twisting machines $D_1$, $D_2$, $D_3$ . . . $D_n$ and the passage $P_1$, placing means C for exchanging trays between each draw-twisting machine and the transportation carrier A are provided.

The transportation carrier A which stands by at a predetermined position on the passage $P_4$ runs along a selected transportation passage in accordance with a control signal issued from a control means (not shown). For example, when full size bobbins doffed from the draw-twisting machines are to be carried from the respective draw-twisting machines to a subsequent stage involved in the section Z, the transportation carrier A goes into the passage $P_1$ from the passage $P_4$ and stops at a position X or Y facing a placing means C disposed beside the prescribed draw-tristing machine. On the carrier A, a pallet is mounted and on this pallet, a plurality of trays holding fresh bobbins is placed. Then, the trays holding fresh bobbins are supplied to the draw-twisting machine from the pallet on the carrier by the placing means C. The emptied pallet then receives trays, whereon a predetermined number of full size bobbins are placed, through the placing means C. After the trays having the full size bobbins mounted thereon are placed on the pallet mounted on the carrier, the movement of the transportation carrier A to the section Z, via the passages $P_2$ and $P_5$, is started. Upon the carrier's arrival at the section Z, the full size bobbins mounted on the trays are unloaded together with the pallet.

On the other hand, in the section Z, another pallet is prepared whereon trays holding fresh bobbins are placed. The emptied transportation carrier A thus is able to receive a pallet having trays holding fresh bobbins placed thereon. Then, the carrier A goes into the passage $P_4$ through the passage $P_6$ and reaches the standby position, and then, waits for the next control signal. Where another transporting operation as mentioned above is required for another draw-twisting machine when the carrier A receives the fresh bobbin pallet, the carrier A goes into the passage $P_1$ directly without passing through the passage $P_4$ and is displaced to the next prescribed position X or Y.

The above explanation concerns an example of the running actions of the transportation carrier A. If the full size bobbins are to be carried to the above-mentioned further section involving, for example, a finishing stage, the transportation carrier A may run along the passage $P_1$ and $P_8$. If the full size bobbins are to be successively transported from any of the respective draw-twisting machines, the carrier may go into the passage $P_6$, without unloading the pallet of full size bobbins mounted thereon, and into the passage $P_1$, and then, be displaced to the next prescribed position X or Y where the above-mentioned placing operation is conducted.

Further, the transportation carrier A may run so that the fresh bobbin trays are supplied to one of the draw-twisting machines while the take-up operation is conducted on said draw-twisting machine and, then, the carrier A returns to the standby position on the passage $P_4$. The transportation carrier A may also run in such a manner that the fresh bobbin trays are supplied to one of the draw-twisting machines while the take-up operation is conducted on said draw-twisting machine. Then, the carrier A is displaced to the next prescribed position X or Y corresponding to another draw-twisting machine whereon the doffing of full size bobbins is completed and at this position, the full size bobbin trays are loaded on the carrier A. Next, the transportation carrier A reaches the section Z where the full size bobbin pallet is unloaded and the fresh bobbin pallet is loaded. Then, the carrier A reaches the standby position.

The above-mentioned transportation operation is made by means of one transportation carrier. However, such transportation operation may be made by means of a plurality of transportation carriers which may be aligned in series on the passage $P_4$. In such a case, the transportation operation may be made in such a manner that the first one of the transportation carriers is displaced to the prescribed position X or Y corresponding to one of the draw-twisting machines and at this position, the fresh bobbin trays are supplied to said draw-twisting machine and then, the carrier A returns to the standby position on the passage $P_4$. Next, the second one of the transportation carriers is displaced to the prescribed position X or Y corresponding to another draw-twisting machine whereon the doffing of full size bobbins is completed and at this position, the full size bobbin trays are loaded on the second carrier. Then, the second carrier reaches the section Z where the full size bobbin pallet is unloaded and the fresh bobbin pallet is loaded. Then, the second carrier reaches the standby position. In this example, the transportation operation as mentioned above may further be repeated by means of the other transportion carriers which standby on the passage $P_4$.

The drive passage selection of the transportation carrier A can be easily controlled by utilizing a recently developed control technique by a computor (not shown). For example, a control system may be advantageously utilized which is composed of a central processing unit and detecting means, such as limit switches and photoelectric devices which are provided, for example, on the draw-twisting machines, transportation carrier and passages, for providing operation start demand signals and operation end demand signals, i.e. operation detecting signals, to the central processing unit. However, since such control technique is not the subject matter of the present invention, the detailed explanation thereof is omitted.

As mentioned hereinbefore, it is one of the important features of the present invention to utilize the tray and the pallet in combination in the transportation of yarn packages. Thus, the tray and the pallet are next explained in detail.

Figure 2A:
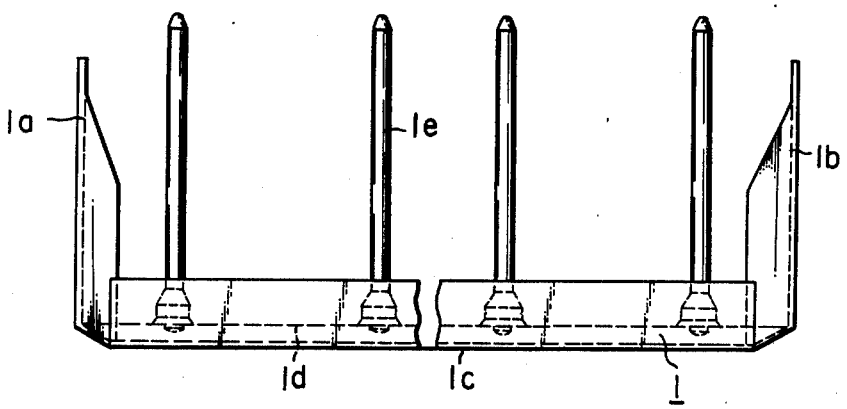
Figure 2B:
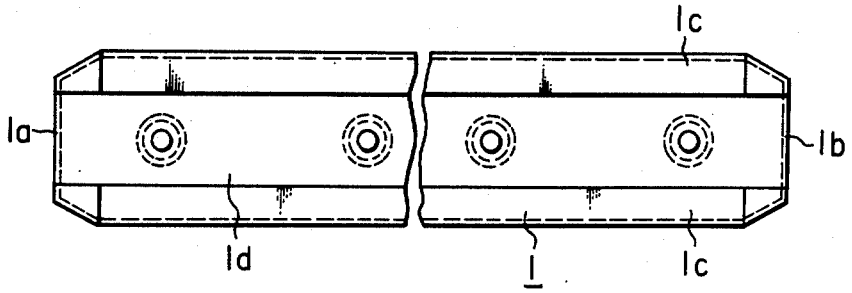
Figure 2C:
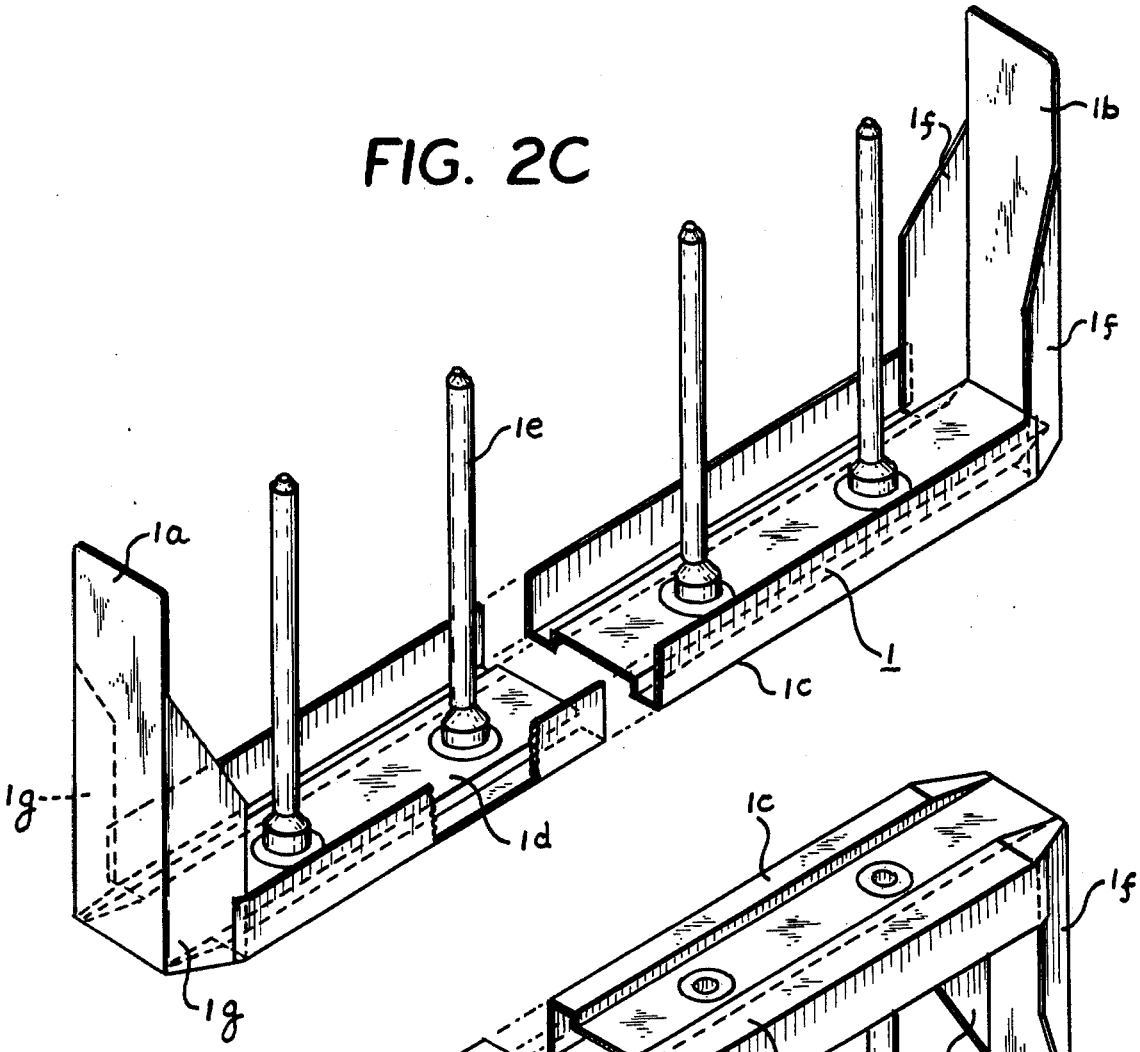
FIG. 2C is a top perspective view.
Figure 2D:
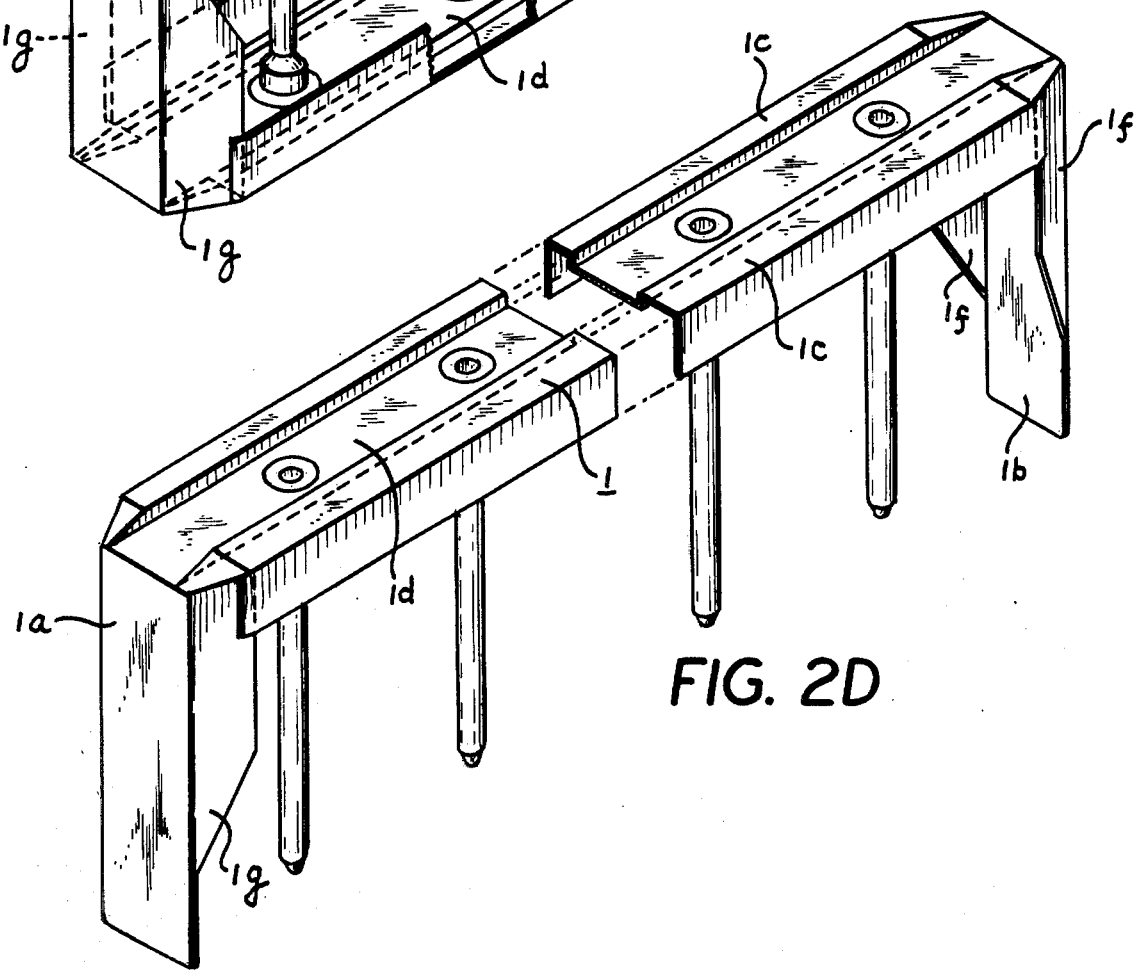
FIG. 2D is a bottom perspective view of the tray shown in in FIGS. 2A and 2B.
Figure 3:
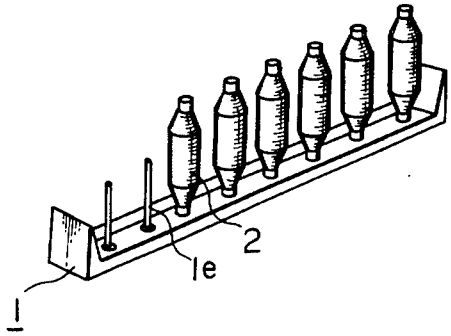
FIG. 3 is a schematic perspective view of the tray, shown in FIGS. 2A and 2B, with a plurality of full size yarn packages placed on a part thereof.

Referring to FIGS. 2A, 2C, and 2D a tray 1 is provided with: a plate-shaped base 1*d;* upright pegs 1*e,* which are fixed to the base 1*d* and aligned with an equal interval therebetween; sliding surfaces 1*c,* which extend in parallel in the longitudinal direction at both sides of the base 1*d,* and also has on the longitudinal opposite ends thereof two pairs of vertical side walls 1*g* and 1*f* which are arranged to be inwardly inclined towards end plates 1*a* and 1*b,* respectively, and; end plates 1*a,* 1*b* which are projected upright at both longitudinal ends of the base 1*d* and provided with upwardly extending surfaces 1*c*. One full size bobbin or fresh bobbin is supported on each peg 1*e*. As is seen from FIG. 3, wherein the tray 1 with full size bobbins 2 placed on a part thereof is schematically shown, the full size bobbins on the tray are kept separate so that they do not contact each other.

Figure 4A:
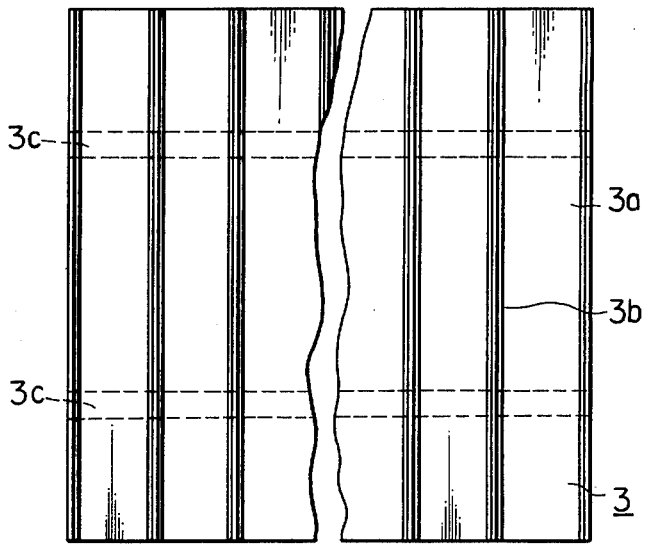
Figure 4B:
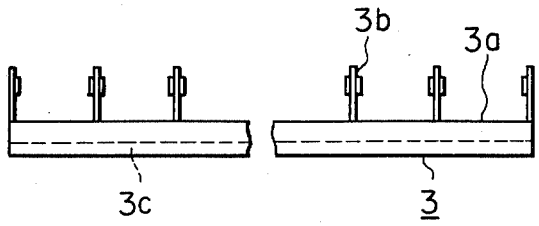

FIGS. 4A and 4B show the above-mentioned pallet. In the figures, the pallet 3 is provided with: a plurality of tray-receiving zones 3*a* which are separated by partition walls 3*b* and on the surfaces of which the above-mentioned sliding surfaces 1*c* of the tray are slidable and; channels 3*c* which are formed in the bottom surface of the pallet 3 in the direction perpendicular to the direction of the receiving zones 3*a* so as to be engaged with rails of a slider of the transportation carrier A, which will be explained in detail hereinafter. On each receiving zone 3*a,* one tray is placed by being slid from one end of the zone.

Figure 5:
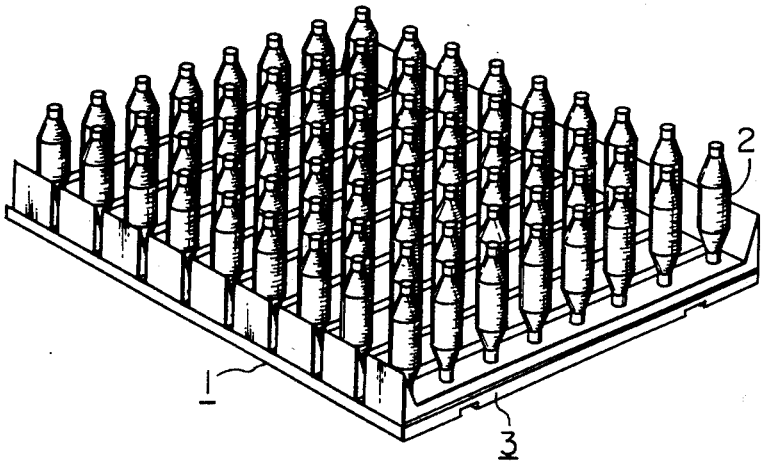
FIG. 5 is a schematic perspective view of the pallet, shown in FIGS. 4A and 4B, whereon a plurality of the trays holding full size yarn packages are placed.

Schematically shown in FIG. 5 is the pallet 3 whereon 9 trays each having 8 full size bobbins mounted thereon are placed.

For the sake of a better understanding of the present invention, more specific explanation will be given below on the basis of the assumption that: the existing draw-twisting machine has 72 spindles on each side of the spindle alignmments, one tray can hole 8 bobbins; 9 trays can be placed on one pallet; 9 trays holding fresh bobbins are aligned in the longitudinal direction at the front of the draw-twisting machine along the aligned spindles, and; each of the 72 pegs of the aligned 9 trays is positioned opposite to each one of the 72 spindles.

Figure 6:
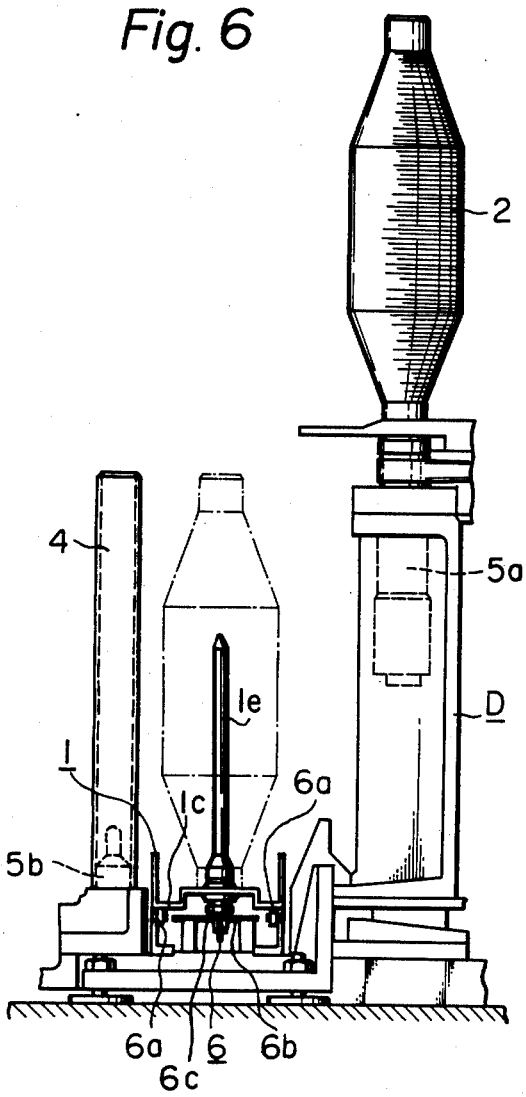
FIG. 6 is a schematic side view of a take-up part of the draw-twisting machine and a front part thereof; adopted for the transportation system shown in FIG. 1.

In FIGS. 6, 7, 8 and 9, the draw-twisting machine, the placing means, the transportation carrier, and the related parts thereof, are schematically shown together with their relative positions. The following explanations will be made mainly with reference to FIGS. 6, 7, 8 and 9 and also with reference to other appropriate figures specifically. As mentioned above, 9 trays each having 8 fresh bobbins mounted thereon are conveyed in the longitudinal direction at the front of the draw-twisting machine D so as to be positioned opposite to each group of 8 spindles. Referring to FIG. 6, the fresh bobbins 4 on the trays 1 are first transferred, by a known automatic doffing apparatus as disclosed, for example, in the above-mentioned Japanese Patent Publication No. 24812/74, onto stationary pegs 5*b* provided on the draw-twisting machine D facing corresponding spindles. Then, full size bobbins 2 are doffed from the spindles 5*a* of the draw-twisting machine D and transferred onto the pegs 1*e* of the emptied trays 1 by the automatic doffing apparatus. The fresh bobbins 4 on the stationary pegs 5*b* are then transferred by the automatic doffing apparatus onto the empties spindles 5*a*. Such bobbin-transferring operation may be conducted at a time with respect to all of the 72 spindles or successively with respect to each one of the 72 spindles or with respect to each group of 8 bobbins corresponding to the 8 pegs of one tray. Thus, the fresh bobbins 4 on the trays 1 supplied along the spindle alignment at the front of the draw-twisting machine D are all set onto the spindles 5*a*, and the full size bobbins 2 on the spindles 5*a* are also all set onto the pegs 1*e* of the trays 1. The level of the tray conveyor is lower than the level of the spindle alignment of the yarn package forming machine.

Figure 10:
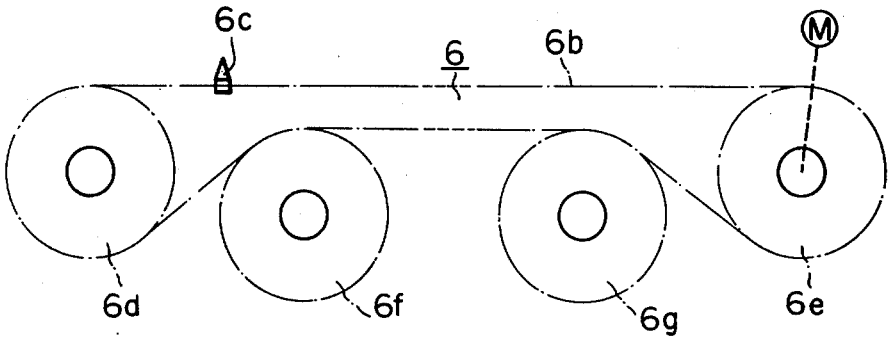
FIG. 10 is a schematic view of a tray conveyor disposed at the front of the draw-twisting machine along the aligned spindles.

The trays 1 each having 8 full size bobbins 2 mounted thereon are conveyed on guide pulleys 6*a* to the longitudinal end of the draw-twisting machine D by a tray conveyor 6. The construction of the tray conveyor 6 is shown in FIGS. 6 and 10, wherein a plurality of the guide pulleys 6*a* is disposed on both sides of a tray-transferring passage provided along the spindle alignment of the draw-twisting machine D so as to form parallel guide passages for the sliding surfaces 1*c* of the tray 1. The tray conveyor 6 is also provided with a chain conveyor 6*b* between the guide pulley alignments on both sides of the tray-transferring passage. A hook 6*c* is provided on the chain conveyor 6*b* for engaging with the base of the tray 1. The base of the tray 1 is engaged by the hook 6*c* and, thus, the tray 1 is forced to move in the conveying direction of the chain conveyor 6*b*. The chain conveyor 6*b* is guide driven by driving sprocket wheels 6*d*, 6*e* and guide sprocket wheels 6*f*, 6*g*. A driving motor M (brake motor No. 1) is also shown in FIG. 10. The chain conveyor 6*b* can be driven intermittently, and the conveying direction thereof is selective.

The term "brake motor" as used herein refers to a motor provided with a brake mechanism.

Figure 7:
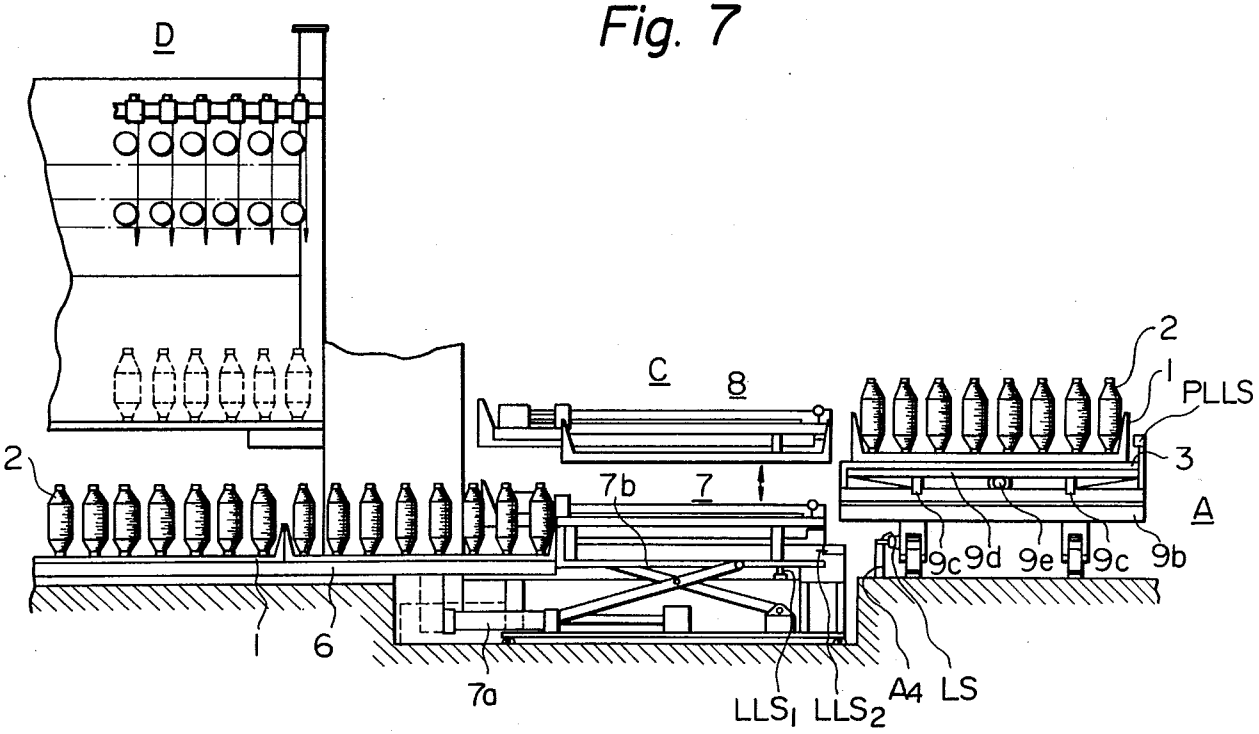
FIG. 7 is a schematic front view of a part of the draw-twisting machine, a placing means and a transportation carrier, adopted for the transportation system shown in FIG. 1, illustrating the relative positions thereof.
Figure 8:
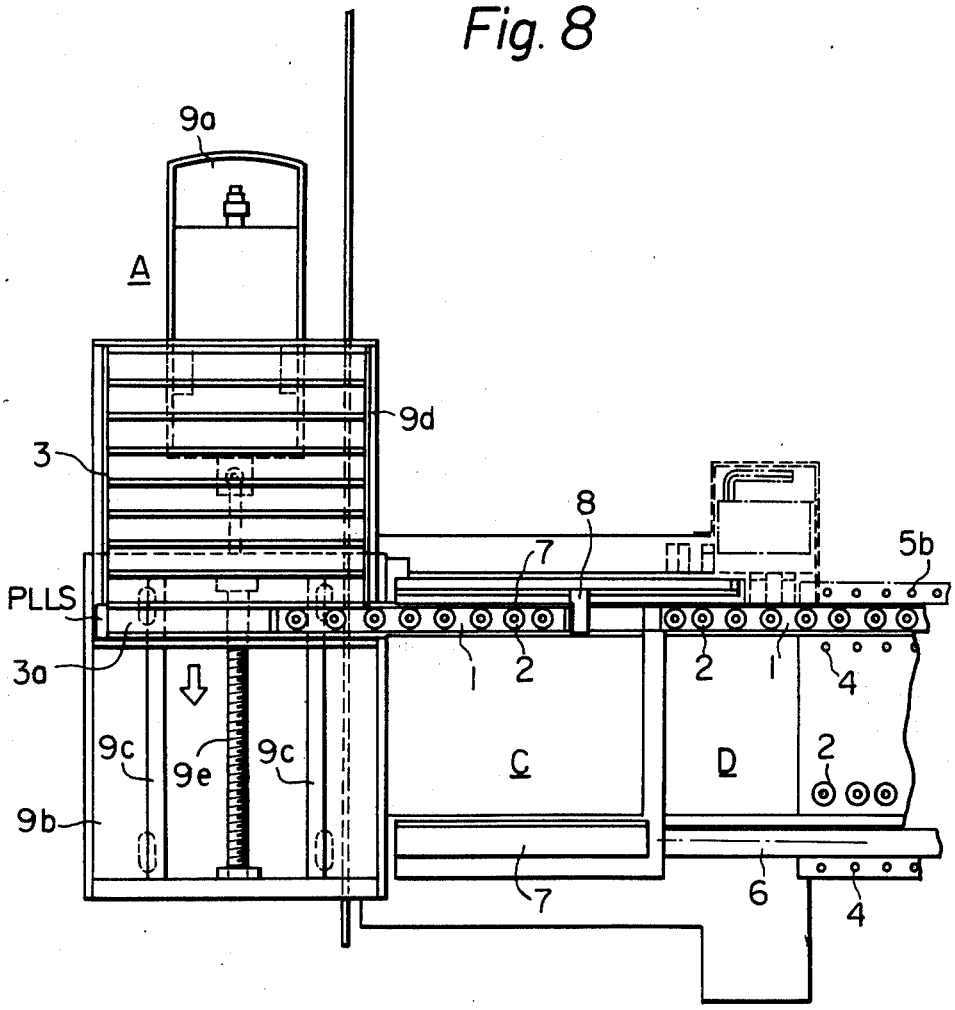
FIG. 8 is a schematic plan view of a part of the draw-twisting machine provided with the placing means and the transportation carrier, shown in FIG. 7.
Figure 9:
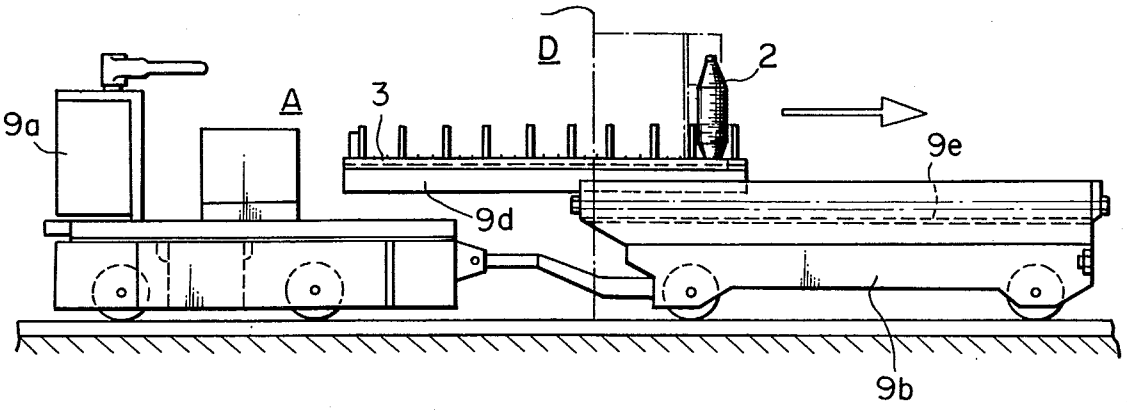
FIG. 9 is a schematic side view of the transportation carrier disposed at the related position shown in FIG. 7.

At the longitudinal outer end of the draw-twisting machine D, a placing means C is disposed as mentioned hereinbefore. A transportation carrier A having the aforementioned pallet 3 (FIG. 4) mounted thereon stands by at the aforementioned position X or Y beyond the placing means C. Referring especially to FIGS. 7 and 8, the placing means C is provided with a lift 7 and a tray-displacing mechanism 8. The lift 7 is provided with an air cylinder 7*a* and a tray-supporting member 7*b* which is moved up and down by the action of the air cylinder 7*a*. The lift 7 is designed in such a way that one stroke of the air cylinder 7*a*, the upper surface of the tray-supporting member 7*b* takes two positions, one of which is a position of the level equal to the upper surface of the tray conveyor 6, and the other is a position of the level equal to the upper surface of the pallet 3 mounted on the transportation carrier A.

Figure 11A:
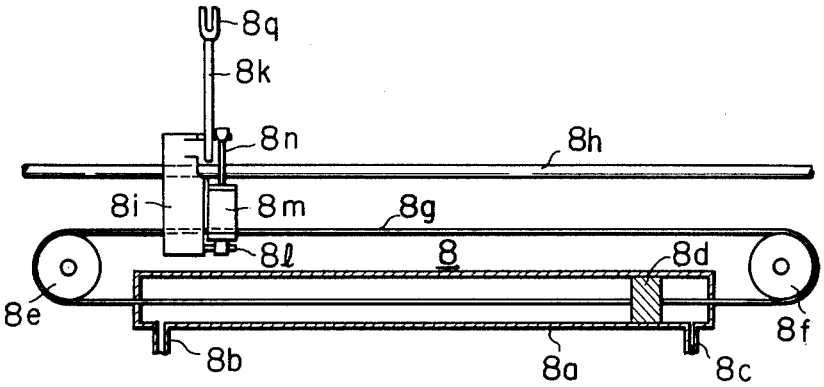
Figure 11B:
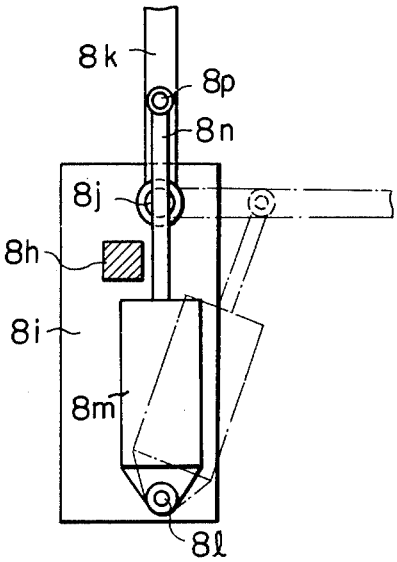
Figure 11C:
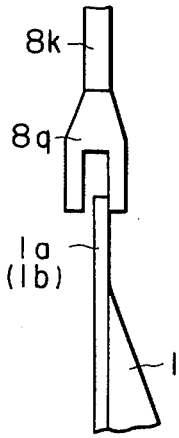

The placing means C is fixedly provided with a tray-displacing mechanism 8 as mentioned above. The construction of the tray-displacing mechanism 8 is shown in FIGS. 11A, 11B and 11C. The tray-displacing mechanism 8 is provided with an air cylinder 8*a*. The air cylinder 8*a* has a piston 8*d* which moves either to the right hand direction or to the left hand direction by the action of compressed air introduced into the cylinder from either of the air inlets 8*b*, 8*c* disposed at both of the end portions of the air cylinder 8*a*. A cord 8*g* is tightly connected to both ends of the piston 8*d* through guide wheels 8*e*, 8*f*. The cord 8*g* may be coated with, for example, an ethylene tetrafluoride resin to impart smoothness and wear resistance to the cord. A bracket 8*i* is fixedly disposed on the cord 8*g*. Said bracket 8*i* slides on a guide rod 8*h* fixedly arranged in parallel to the cord 8*g*. In addition, the bracket 8*i* is provided with a tray-holding arm 8*k* which is pivotably supported around a fixed axis 8*j*. An air cylinder 8*m* is pivotably supported around another axis 8*l* on the bracket 8*i*, and the end portion of a rod 8*n* of the air cylinder 8*m* is pivotably fixed to the tray-holding arm 8*k* by a pin 8*p* so that the tray-holding arm 8*k* can be pivoted by the motion of the air cylinder 8*m* from a position indicated, in FIG. 11B, by solid lines to a position indicated, in FIG. 11B, by dot-dashed lines. The end portion of the tray-holding arm 8*k* forms a forked holding member 8*q* which can be engaged with the aforementioned end plate 1*a* or 1*b* of the tray 1 as shown in FIG. 11C.

Figure 12:
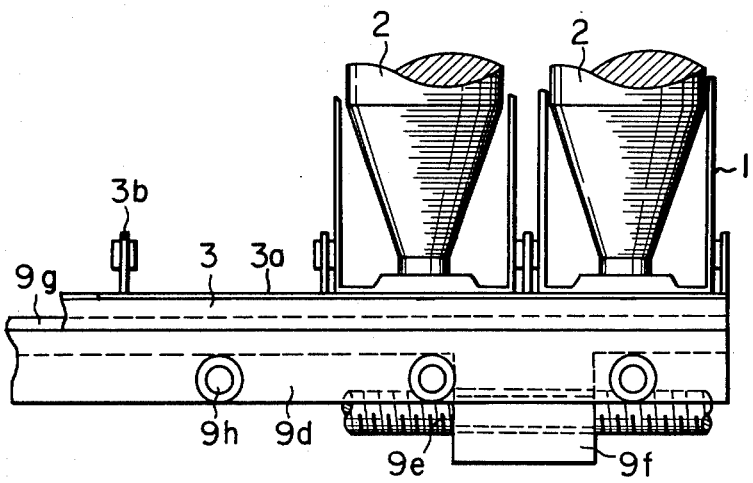
FIG. 12 is an enlarged side view schematically illustrating the main part of the transporting carrier shown in FIG. 9.

As mentioned above and as shown in FIG. 8, a transportation carrier A stands beside the placing means C. The transportation carrier A comprises a driving truck 9*a* such as a battery driven truck and a carrier 9*b* connected to the driving truck 9*a*. A slider 9*d* which moves slidably along channels 9*c* is disposed on the upper surface of the carrier 9*b*. The slider 9*d* is engaged with a screw shaft 9*e* driven by a brake motor (brake motor No. 2) (not shown) and is stepwise moved to the arrow direction. As is shown in detail in FIG. 12, the screw shaft 9*e* is engaged with a flange 9*f* fixed on the slider 9*d*; two rails 9*g* engaged with the aforementioned channels 3*c* (FIG. 4A) of the pallet 3 are provided on the upper surface of the slider 9*d*; and further, nine photo-receivers 9*h* receiving light rays from a photo-projector (not shown) provided on the draw-twisting machine are provided in the side wall of the slider 9*d*. The mounting center of each of the photo-receivers 9*h* coincides with the center of each tray-receiving zones 3*a* of the pallet 3 mounted on slider 9*d*. Furthermore, the slider 9*d* moved into the channels 9*c* by the screw shaft 9*e* is designed in such a way that the slider 9*d* stops when one of the photo-receivers 9*h* receives a light ray from the photo-projector. At this time, the center of the aforementioned tray conveyor 6 (FIG. 6) coincides exactly with the center of the tray-receivng zone 3*a* of the pallet 3.

As hereinbefore mentioned, the trays 1 having full size bobbins 2 mounted thereon are conveyed to the longitudinal outer end of the draw-twisting machine D by the tray conveyor 6. The loading operation of the trays 1 onto the pallet 3 will be explained below with reference to FIGS. 6, 7, 8, 9, 10, 11A, 11B, 11C, 12 and 13.

Figure 13:
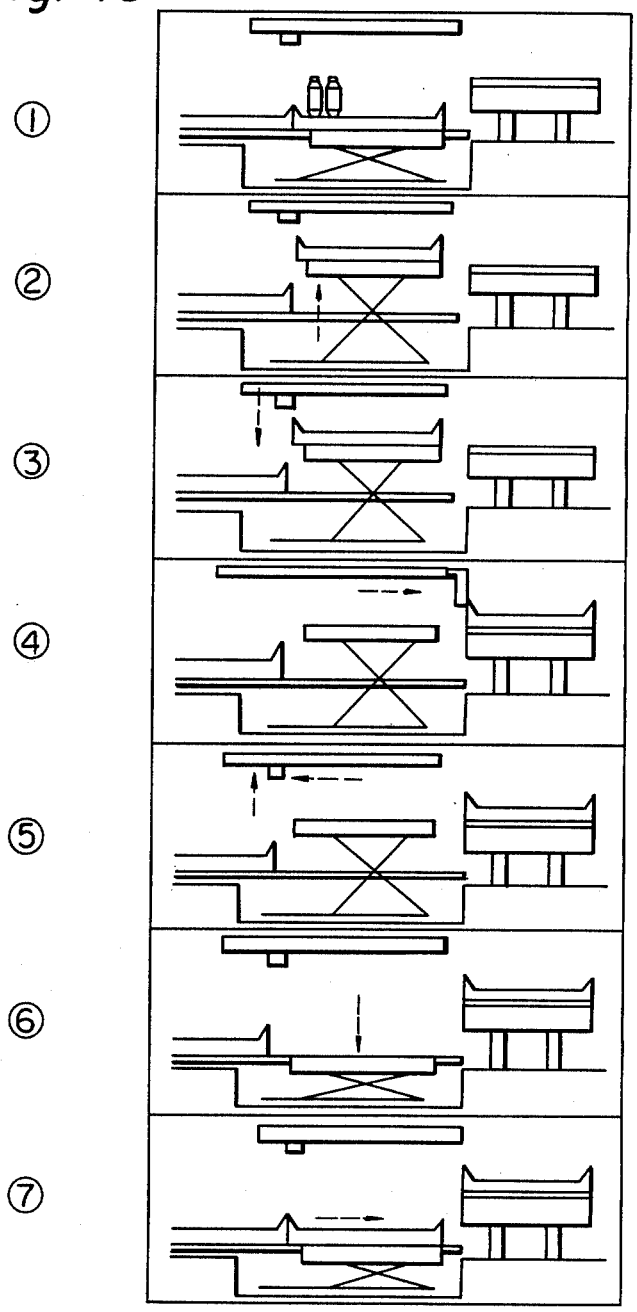
FIG. 13 shows schematic side views of successive steps of the transportation of yarn packages according to the invention, wherein full size bobbins are taken out from a draw-twisting machine and placed on a transportation carrier.

The first one of the 9 trays 1 holding full size bobbins 2 is initially transferred onto the tray-supporting member 7*b* of the lift 7 of the placing means C by the tray conveyor 6 (FIG. 13①). The other trays 1 are still placed on the tray conveyor 6.

Secondly, the lift 7 is moved up by the motion of one stroke of the air cylinder 7*a* to a level at which the upper surface of the tray-supporting member 7*b* of the lift 7 is coincident with the upper surface of the pallet 3 (FIG. 13②).

Thirdly, the tray-holding arm 8*k* is pivoted, from a position indicated by solid lines to a position indicated by dot-dashed lines in FIG. 11B, by the motion of the air cylinder 8*m* of the tray-displacing mechanism 8 and, thus, the holding member 8*q* of the arm is engaged with the end plate 1*a* (or 1*b*) of the tray 1 (FIG. 13③).

Fourthly, compressed air is introduced into the cylinder of the air cylinder, 8*a* of the tray-displacing mechanism 8 from the air inlet 8*c*. Fifthly, the piston 8*d* is moved to the left hand direction of FIG. 11A; the bracket 8*i* is moved to the right hand direction of FIG. 11A while being guided by the guide rod 8*h*. Thus, the tray 1 placed on the tray-supported member 7*b* of the lift 7 is pushed away from the tray-supporting member surface and set in the first one of the receiving zones 3*a* of the pallet 3 mounted on the transportation carrier A (FIG. 13④).

Sixthly, the tray-holding arm 8*k* is reinstated to the original position, indicated in FIG. 11B by solid lines, by the motion of the air cylinder 8*m* of the tray-displacing mechanism 8. Compressed air is then introduced from the other air inlet 8*b* of the air cylinder 8*a* of the tray-displacing mechanism 8, and, thus, the bracket 8*i* is moved to the left hand direction of FIG. 11A so as to be reinstated back to the original position while being guided by the guide rod 8*h* (FIG. 13⑤).

Seventhly, the lift 7 is moved down by the motion of the air cylinder 7*a* to reinstate said lift to its original position at which it was positioned before being moved up (FIG. 13⑥). At this time, the screw shaft 9*e* is rotated by the motion of the brake motor (not shown) for driving the slider 9*d* of the transportation carrier A, and, thus, the slider 9*d* is moved into the direction of the arrow shown in FIGS. 8 and 9. When the second one of the photo-receivers 9*h* receives the light ray from the photo-projector (not shown) provided on the draw-twisting machine D, the brake motor stops rotating and then the rotation of the screw shaft 9*e* stops. Thus, the preparation for the operation of transferring the second one of the trays 1 onto the pallet 3 is completed.

Eighthly, the second tray 1 is pushed away from the front of the draw-twisting machine D onto the tray-supporting member 7*b* of the lift 7 by the motion of the tray conveyor 6 (FIG. 13⑦). The above-mentioned operation is then successively repeated, and, thus, all of the 9 trays are loaded onto the pallet 3.

The above-mentioned tray-transferring operation may be carried out automatically using, for example, an electrical control mechanism. An embodiment of such a control mechanism will be explained below with reference to FIGS. 14A, 14B and 14C, specifically.

Figure 14A:
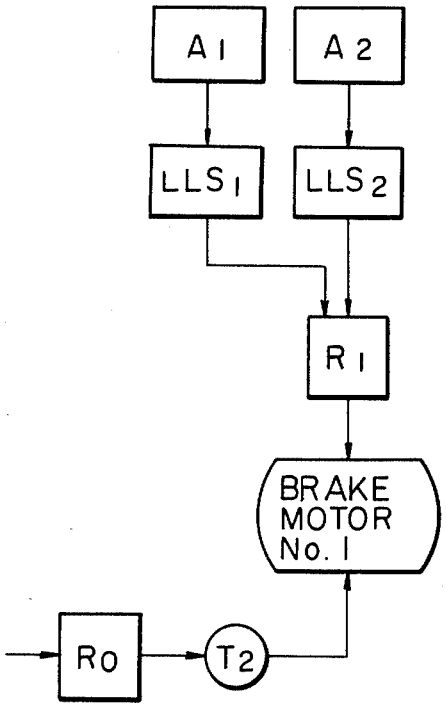
FIGS. 14A, 14B and 14C are block diagrams indicating actuating mechanisms when full size bobbins are taken out from a draw-twisting machine and placed on a transportation carrier.

FIG. 14A is a block diagram indicating the actuating mechanism utilized which operates during when the trays 1 are being transferred from the front of the draw-twisting machine onto the tray-supporting member 7*b* of the lift 7. The rotation of the brake motor No. 1 is started when a signal is given through a relay $R_O$ and a timer $T_2$, which signal is issued when the doffing operation is completed. Thus, the tray conveyor 6 is driven and the tray 1 is transferred onto the lift 7 which is at the moved-down level. When the tray 1 is placed on the lift 7, a limit switch $LLS_2$ which is provided on the frame of the placing means C is actuated by a lift actuator $A_2$ which is the end plate 1*a* (or 1*b*) of the tray 1 and a relay $R_1$ is then released by a signal issued from the limit switch $LLS_2$ to stop the rotation of the brake motor No. 1.

When the lift 7 is moved down after the lift 7 is moved up and the tray 1 is placed onto the pallet on the transportation carrier, a limit switch $LLS_1$ which is provided on the frame of the placing means C underneath the lift 7, as shown in FIG. 7, is actuated by a tray conveyor actuator $A_1$ which is the bottom surface of the tray-supporting member 7*b*. A relay $R_1$ is then closed by a signal issued from the limit switch $LLS_1$ so that a signal is issued for starting the rotation of the brake motor No. 1 which drives the tray conveyor 6.

Figure 14B:
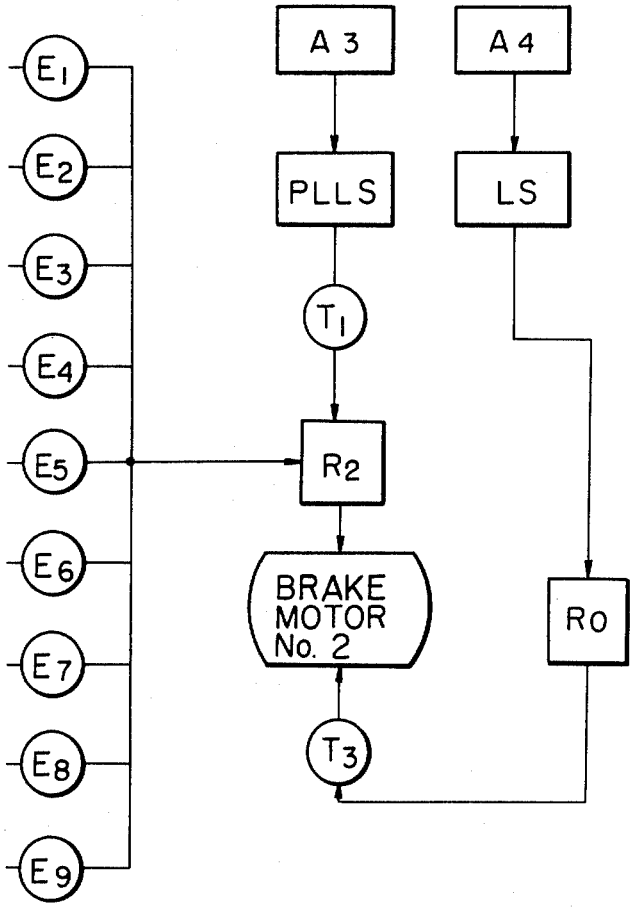

FIG. 14B is a block diagram indicating the actuating mechanism which operates during when the tray is transferred from the tray-supporting member 7*b* of the lift 7 onto the receiving zone 3*a* of the pallet 3. When the transportation carrier A reaches the prescribed position X or Y mentioned hereinbefore, a limit switch LS provided on the frame of the transportation carrier A is actuated by a carrier actuator $A_4$ provided beside the transportation passage $P_1$. Then, a relay $R_O$ is closed by a signal issued from the limit switch LS for issuing a signal for starting the rotation of the brake motor No. 2 on the transportation carrier A through a timer $T_3$. Thus, the brake motor No. 2 is rotated to move the slider 9*d* on the transportation carrier A in the direction opposite to the arrow in FIG. 8 so that the pallet 3 is displaced to the position indicated in FIG. 8. When the slider is moved to a position at which the first one of the photo-receivers 9*h* receives the light ray from the photo-projector on the draw-twisting machine, a signal is issued from a signal generator $E_1$ which is disposed in the first photo-receiver thereby releasing the relay $R_2$. Thus, the rotation of the brake motor No. 2 is stopped and the center of the first one of the tray-receiving zones 3*a* of the pallet 3 on the slider 9*d* becomes coincident with the center of the tray conveyor 6 so that the first receiving zone 3*a* is ready for receiving the first tray on the tray-supporting member 7*b* of the lift 7.

When the first tray on the tray-supporting member 7*b* of the lift 7 is pushed and set in the first tray-receiving zone 3*a* of the pallet 3, a limit switch PLLS provided on the frame of the carrier 9*b* of the transportation carrier A is actuated by a pallet actuator $A_3$ which is the end plate 1*a* (or 1*b*) of the first tray 1. Then, the relay $R_2$ is closed by a signal issued from the limit switch PLLS so that the brake motor No. 2 is again rotated by a signal issued from the relay $R_2$ for moving the slider 9*d* on the transportation carrier A. When the slider is moved to the next position at which the second one of the photo-receivers 9*h* receives the light ray from the photo-projector on the draw-twisting machine, a signal is issued from a signal generator $E_2$ which is disposed in the second photo-receiver whereby the relay $R_2$ is again released for stopping the movement of the slider 9*d*. Then, the above-mentioned operation is repeated.

Figure 14C:
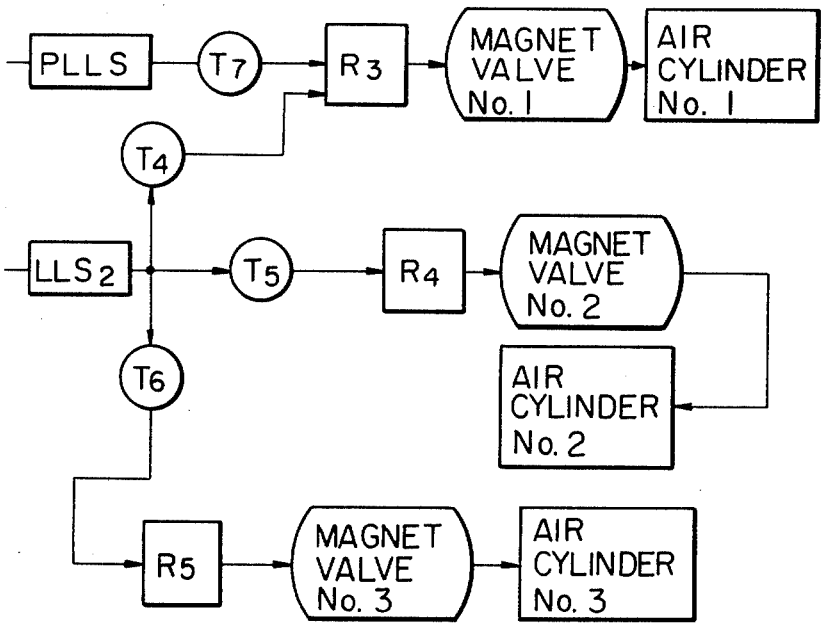

FIG. 14C is a block diagram indicating the mechanism for actuating the air cylinders provided on the placing means C. When the limit switch $LLS_2$ is actuated as mentioned above, a signal issued from the limit switch $LLS_2$ is actuated as mentioned above, a signal issued from the limit switch $LLS_2$ is applied to a relay $R_3$ through a timer $T_4$ so that the relay $R_3$ is closed to excite a magnet valve No. 1 connected to the air cylinder 7*a* shown in FIG. 7 (air cylinder No. 1). Thus, the air cylinder No. 1 (air cylinder 7*a*) is actuated and the lift 7 is moved up. A relay $R_4$ is closed later than the relay $R_3$ by a signal applied from the limit switch $LLS_2$ through a timer $T_5$. Thus, a magnet valve No. 2 connected to the air cylinder 8*m* shown in FIG. 11B (air cylinder No. 2), is excited thereby actuating the air cylinder No. 2 (air cylinder 8*m*). The tray-holding arm 8*k* then becomes engaged with the end plate 1*a* (or 1*b*) of the tray 1. Next, a relay $R_5$ is closed later than the relay $R_4$ by a signal applied from the limit switch $LLS_2$ through a timer $T_6$ so that a magnet valve No. 3 connected to the air cylinder 8*a* shown in FIG. 11A (air cylinder No. 3) is excited. The air cylinder No. 3 (air cylinder 8*a*) is thereby actuated to push the tray 1 engaged with the tray-holding arm 8*k* into the tray-receiving zone 3*a* of the pallet 3.

When the tray 1 is set in the receiving zone 3*a*, the limit switch PLLS is actuated as mentioned above. Thus, the relay $R_3$ is released by a signal applied from the limit switch PLLS through a timer $T_7$ to excite the magnet valve No. 1 and actuate the air cylinder No. 1 in the opposite direction, while in a similar way the air cylinder No. 2 and the air cylinder No. 3 are actuated in the opposite direction.

Figure 15:
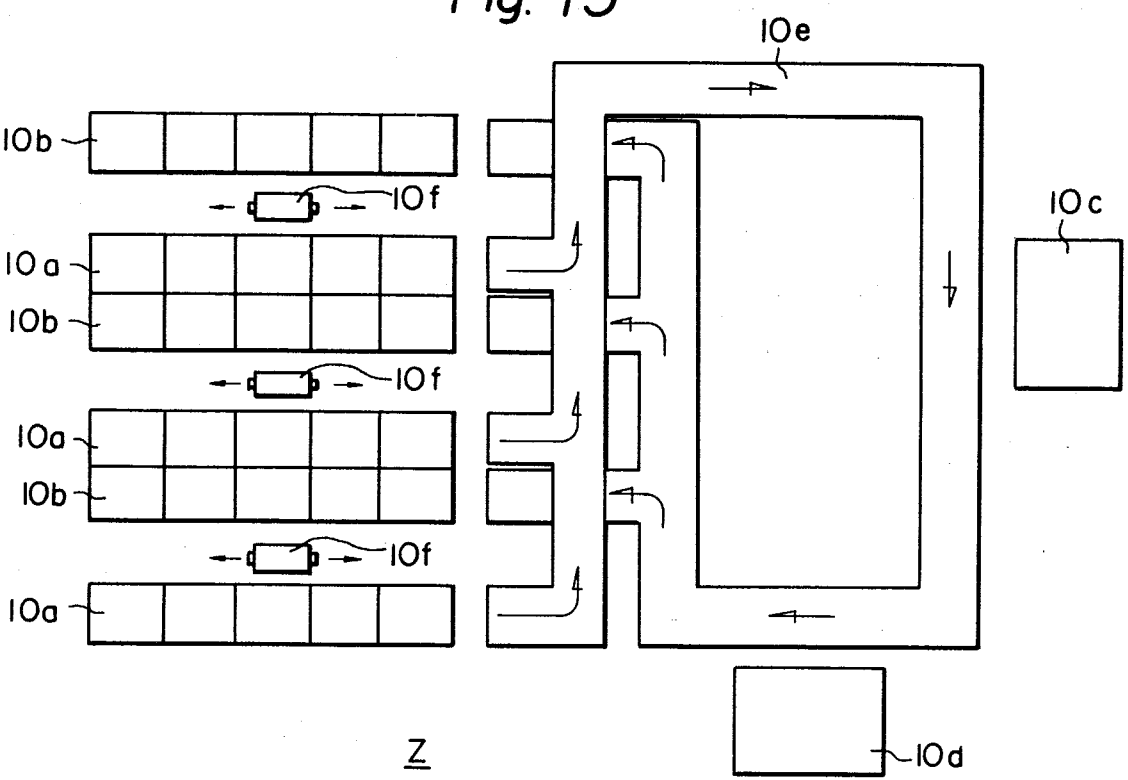
FIG. 15 is a schematic plan view of the section Z shown in FIG. 1, involving the subsequent stages of the draw-twisting.

As explained hereinbefore with reference to FIG. 1, the transportation carrier A having full size bobbins mounted thereon is displaced to the section Z which involves the subsequent stages of the yarn processing, via the transportation passages $P_2$ and $P_5$. FIG. 15 schematically shows the section Z.

The section Z comprises warehouses 10*a* for storing the pallets having full size bobbins placed thereon, warehouses 10*b* for storing the pallets having fresh bobbins placed thereon, a station 10*c* for inspecting and classifying the full size bobbins and a station 10*d* for preparing fresh bobbins to be supplied to the draw-twisting machines. The warehouses 10*a* and 10*b*, the inspection and classification station 10*c* and the preparation station 10*d* are connected to each other through a conveyor 10*e*. Further, cranes 10*f* are provided between the warehouses 10*a* and the warehouses 10*b*.

The full size bobbins conveyed to the section Z by the transportation carrier A are unloaded together with the pallet 3 by means of the crane 10*f* and entered into the warehouse 10*a*. Then, a pallet having trays holding fresh bobbins mounted thereon is taken out from the warehouse 10*b* disposed opposite to the warehouse 10*a* and then loaded on the transportation carrier A also by means of the crane 10*f*. Thereafter, the transportation carrier A, whereon the pallet having fresh bobbins placed thereon is mounted, goes into the transportation passage $P_6$ as explained with reference to FIG. 1.

The full size bobbins once entered into the warehouse 10*a* are taken out, as desired, together with the pallet and placed on the conveyor 10*e* by the crane 10*f*. The full size bobbins conveyed together with the pallet on the conveyor 10*e* are pulled out from the pegs of the trays mounted on the pallet, inspected and classified at the inspection and classification station 10*c* and, then, conveyed to the subsequent packing stage. On the pegs of the emptied trays on the pallet, fresh bobbins are placed at the preparation station 10*d*. The pallet having fresh bobbins mounted thereon is conveyed on the conveyor 10*e* and entered into the warehouse 10*b* by means of the crane 10*f*.

By the way, as hereinbefore explained with reference to FIG. 1, the transportation carrier A, whereon trays having fresh bobbins placed thereon are loaded at the section Z, goes into the transportation passage $P_1$ via the passage $P_6$ and stops at a position X or Y facing toward a draw-twisting machine from which full size bobbins are to be taken out next. Then, the 9 trays having fresh bobbins placed thereon are supplied to the draw-twisting machine one by one. The supply of the tray can be carried out in a way which is substantially the same as in the above-mentioned case where full size bobbins are taken out from a draw-twisting machine, except that the sequence of operation is reversed. Thus, the operation in this case will be briefly explained below with reference mainly to FIG. 16.

Figure 16:
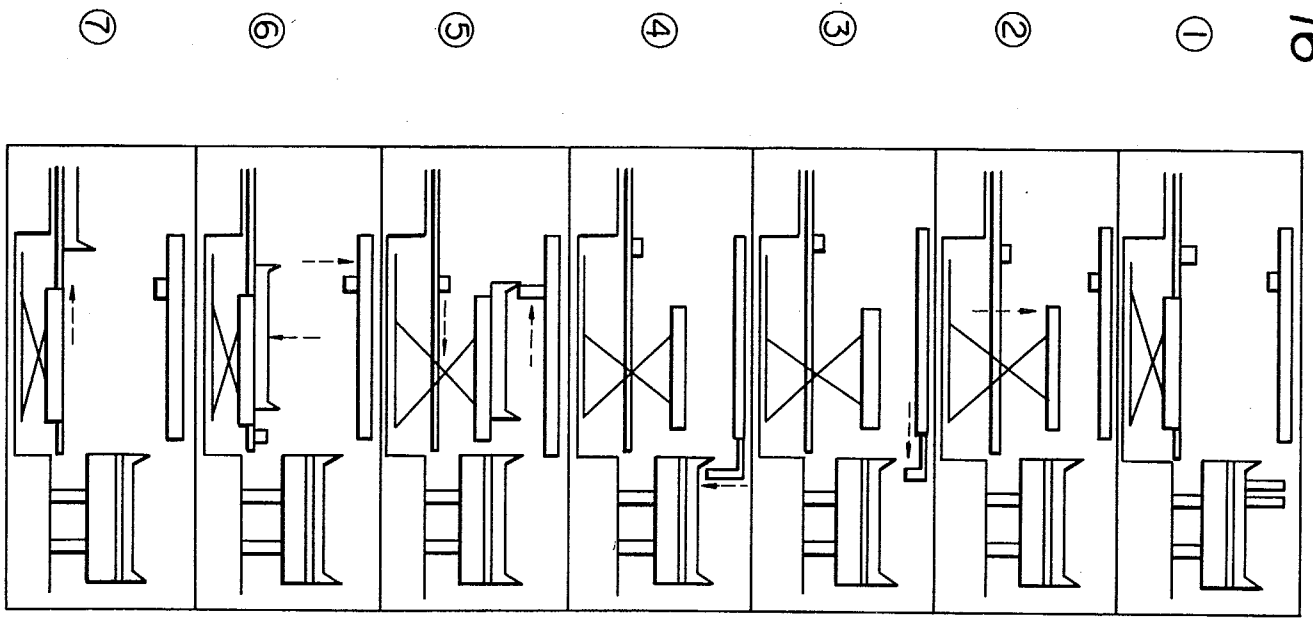
FIG. 16 shows schematic side views of successive steps of the transportation of yarn packages according to the the invention, wherein fresh bobbins are unloaded from a transportation carrier and supplied to a draw-twisting machine.

The transportation carrier A, whereon the pallet having the trays holding fresh bobbins placed thereon is mounted, stops at a prescribed position X or Y (FIG. 16 ①).

Then, the lift is moved up to a level at which the trays on the pallet can be received (FIG. 16②).

Then, the tray-holding arm of the tray-displacing mechanism is moved in the direction toward the pallet (FIG. 16③).

Next, the tray-holding arm is pivoted and engaged with the end plate of the tray (FIG. 16④), and then, pulls out the tray onto the tray-supporting member of the lift (FIG. 16⑤).

Then, the lift is moved down to the original level (FIG. 16⑥).

Next, the tray on the tray-supporting member is engaged with the hook 6*c* of the tray conveyor 6 (c.f. FIGS. 6 and 10), and then, supplied to the front of the spindle alignment of the draw-twisting machine (FIG. 16⑦). At the same time, the slider on the transportation carrier is moved for a length corresponding to the width of the tray-receiving zone of the pallet so that the second one of the trays is taken out from the pallet. Then, the above-mentioned operation is successively repeated to align the trays on the tray conveyor at the front of the draw-twisting machine.

This operation may also be carried out automatically in the manner as mentioned hereinbefore with reference to FIGS. 14A, 14B and 14C. The subsequent doffing operation may also be carried out as hereinbefore mentioned.

In the embodiment explained above in detail, bobbins are transported between the draw-twisting stage and subsequent stage of the draw-twisting processing of yarns. However, it should be noted that the invention is not limited to only such an embodiment. Accordingly, the yarn package forming machine should not be limited to only a draw-twisting machine but should also include a drawing machine, spin-winding machine, spin-draw-winding machine, false-twisting machine, draw-false-twisting machine or the like. The invention can also be applied to the transportation of yarn packages between the successive yarn processing machines of different types.

Further, in the above-mentioned embodiment, if the level of the tray conveyor at the front of the draw-twisting machine is disposed to coincide with the level of the pallet on the transportation carrier, the lift of the placing means disposed between the machine and the carrier is apparently not necesssary.

The tray may be designed in such a way that the bobbins are supported horizontally, as long as the bobbins are kept separate so that they do not contact each other. If full size bobbins contact each other or a portion of the tray, the wound yarns may disadvantageously be soiled or broken. The tray is preferably designed so that the bobbins are perpendicularly supported as in the above-mentioned embodiment, since many of the conventional yarn package processing machines such as the aforementioned known doffing apparatus are designed to process yarn packages in a perpendicular state.

The pallet may be designed to receive any number of trays. However, since it is usual that an identical kind of yarn is processed on one yarn processing machine, if the machine has take-up means aligned on both sides as in the mentioned draw-twisting machine, it is preferred that the pallet be designed in such a way that all of the yarn packages from at least one side of the machine are transported as one unit. In such a case, the labeling process of the formed yarn packages becomes an easy operation, and the space required for storing the formed yarn packages can be greatly reduced.

What is claimed is:

1. An apparatus for transporting a group of yarn packages between a yarn package forming machine and a subsequent stage of yarn processing, comprising:

a tray for holding a predetermined plurality of yarn packages in such a condition that said yarn packages are kept separate from contacting each other, a pallet for placing a predetermined plurality of said trays thereon, a transportation carrier for carrying said pallet placed thereon, a transportation passage connecting said yarn package forming machine to the subsequent stage of yarn processing, a tray conveyor disposed at the front of said yarn package forming machine along the spindle alignment of said yarn package forming machine in such a condition that the level of said tray conveyor is lower than the level of said spindle alignment of said yarn package forming machine, and a placing means comprising a lift and a tray-displacing mechanism whereby said trays are moved up and down between the level of the upper surface of said tray conveyor and the level of the upper surface of said pallet placed on said transportation carrier and exchanged between said tray conveyor and said pallet on said transportation carrier, said transportation carrier being disposed beside one of the longitudinal outer ends of said yarn package forming machine so that said placing means is positioned between said one longitudinal outer end of said yarn package forming machine and said transportation carrier.

2. An apparatus according to claim 1, wherein said tray has a predetermined plurality of pegs perpendicularly fixed thereon with an equal interval for holding said predetermined plurality of yarn packages perpendicularly without causing any contacting between said yarn packages.

3. An apparatus according to claim 1, wherein said pallet has a surface for receiving said predetermined plurality of trays, on which surface the bottom surfaces of said trays are slidable, and said surface forms a plurality of tray-receiving zones separated by partition walls.

4. An apparatus according to claim 1, wherein said transportation carrier has a slider for positioning said pallet on the upper surface of said carrier and a slider-displacing mechanism under the bottom surface of said slider.

5. An apparatus according to claim 1, wherein said pallet is designed so that all of said yarn packages from at least one side of said yarn package forming machine are transported as one unit.

6. An apparatus according to claim 1, wherein:

said yarn package forming machine is selected from a drawing machine, draw-twisting machine, spin-winding machine, spin-draw-winding machine, false-twisting machine and draw-false-twisting machine.

7. An apparatus for transporting a group of yarn packages between successive stages of yarn processing, comprising:

a tray for holding a predetermined plurality of yarn packages in such a condition that said yarn packages are kept from contacting each other;

a pallet for placing a predetermined plurality of the trays thereon and a transportation carrier for carrying said pallet placed thereon;

said pallet having a surface for receiving said predetermined plurality of trays, on which surface the bottom surfaces of said trays are slidable;

the receiving surface of said pallet forming a plurality of tray-receiving zones separated by partition walls which stand upright and straight and extend along the whole length of each of said tray-receiving zones; and, said trays having upright and straight side walls which are slidable against said partition walls of said pallet, and said trays having on the longitudinal opposite ends of the bottom thereof upwardly inclined surfaces and also having on the longitudinal opposite ends thereof two pairs of vertical side walls which are arranged to be inwardly inclined, whereby to facilitate the entry of said trays into said pallet.

8. An apparatus according to claim 7, wherein said transportation carrier has a slider for positioning said pallet on the upper surface of said carrier and a slider displacing mechanism under the bottom surface of said slider.

9. An apparatus according to claim 8, wherein:

said slider has on the upper surface thereof a longitudinal projection and said pallet has on the bottom surface thereof a channel engageable with said longitudinal projection of said slider.

* * * * *

UNITED STATES PATENT AND TRADEMARK OFFICE

CERTIFICATE OF CORRECTION

PATENT NO. : 4,144,961

DATED : March 20, 1979

INVENTOR(S) : Masao Kasahara et al

It is certified that error appears in the above-identified patent and that said Letters Patent are hereby corrected as shown below:

| | |
|---|---|
| Col. 3, Line 48 | after the word thereof delete ";" and insert --,-- |
| Col. 4, Line 18 | delete "the" second occurrence |
| Col. 6, Line 2 | after "machine" insert --,-- |
| Col. 6, Line 35 | after "2A," insert --2B,-- |
| | after "2D" insert --,-- |
| Col. 7, Line 3 | change to read --the spindle alignments; one tray can hold 8 bobbins; 9-- |
| Col. 7, Line 12 | "explanations" should be --explanation-- |
| Col. 7, Line 30 | "empties" should be --emptied-- |
| Col. 8, Line 7 | after "that" insert --by-- |

UNITED STATES PATENT AND TRADEMARK OFFICE

CERTIFICATE OF CORRECTION

PATENT NO. : 4,144,961

DATED : March 20, 1979

INVENTOR(S) : Masao Kasahara et al

It is certified that error appears in the above-identified patent and that said Letters Patent are hereby corrected as shown below:

Col. 11, Lines 9 and 10 delete "is actuated as mentioned above, a signal issued from the limit switch $LLS_2$"

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*